United States Patent [19]

Pittaway et al.

[11] Patent Number: 4,749,181

[45] Date of Patent: Jun. 7, 1988

[54] MOTOR-DRIVEN EXERCISE APPARATUS HAVING RUNAWAY PREVENTION SYSTEM

[76] Inventors: James W. Pittaway, 555 S. Illinois, Anaheim, Calif. 92805; James S. Sweeney, Jr., 2775 Temple Hills, Laguna Beach, Calif. 92651

[21] Appl. No.: 913,327

[22] Filed: Sep. 30, 1986

[51] Int. Cl.[4] ..... A63B 23/06

[52] U.S. Cl. ..... 272/69; 272/100; 272/DIG. 9

[58] Field of Search ..... 272/69, 100, DIG. 9; 340/323 R

[56] References Cited

U.S. PATENT DOCUMENTS 3,711,812 1/1973 Cherry ..... 272/69

*Primary Examiner*—Leo P. Picard

*Attorney, Agent, or Firm*—Thomas J. Plante

[57] ABSTRACT

A motor-driven exercise apparatus is disclosed, which incorporates a plurality of runaway-preventing features, thus reducing the chance of injury to the user. A motor control circuit is effectively controlled by pulse width modulated commands from a CPU, and by frequency-variable feedback information. These data are converted to voltages and input to a differential amplifier. A relay switch is used to cause immediate power turn off at both speed and elevation motors if any of the following occurs: (a) loss of feedback signal from the speed feedback at the CPU, (b) too rapid speed change sensed by the CPU, (c) failure of the motor control circuit to receive a signal from the CPU within a certain period, or (d) an elevation motor runaway sensed by the CPU.

18 Claims, 6 Drawing Sheets

MOTOR-DRIVEN EXERCISE APPARATUS HAVING RUNAWAY PREVENTION SYSTEM

BACKGROUND OF THE INVENTION

This invention relates to exercise apparatus, and primarily to protection of the user against possible injury due to failure of the control system. The problems occur in the context of running/walking machines, or treadmills. However, the solutions may be applicable in any exercise apparatus where the speed (or force) of operation is determined by a motor, or motors, running under prestablished commands, as distinguished from exercise apparatus where the user-exerted energy controls the speed (or force) of operation, i.e., where the apparatus functions by resisting the user's energy. The resistance types of exercise apparatus include cycling machines, rowing machines, and the like.

In a running machine, or treadmill, a moving motor-driven belt determines the running, or walking, speed which the user must maintain in order to stay on the belt. A sudden undersired belt speed-up will throw the user off, with a risk of injury. Many such machines lack adequate safety protection against such a functional failure, with its inherent risks to the user.

The following describes an example of a potentially damaging event. In the apparatus, speed commands are entered and stored in a computer control system. Feedback representing actual speed is obtained from a sensor, such as a tachometer or an optical encoder. The motor speed control system compares the command and feedback signals, for the purpose of obtaining, and maintaining, the desired speed. If, for any reason, the feedback signal is lost, the automatic speed control system, if protective precautions are lacking, will "assume" that the belt has stopped; and therefore, power to the motor will be automatically and rapidly increased up to the maximum available. This would create a potentially dangerous runaway condition. Since the belt is moving toward the rear, its rapidly increasing speed can throw the user backward with a very powerful force.

The present invention is intended to provide much greater user protection than that previously incorporated in apparatus of the type under discussion.

SUMMARY OF THE INVENTION

The present invention provides maximum user protection in a motor-driven exercise apparatus. It includes both a safety system in the computer control unit (CPU) and "watch-dog" circuitry in the motor control unit.

Additionally, the motor speed control system provides an unusually close correlation of actual speed with command speed, thus making system failure relatively easy to detect.

The safety features are so arranged as to have cross-checking capability, i.e., each portion of the control system will detect a functional failure in another portion, and will have its own failure detected in another portion.

DETAILED DESCRIPTION OF PREFERRED EMBODIMENT

Figure 1:
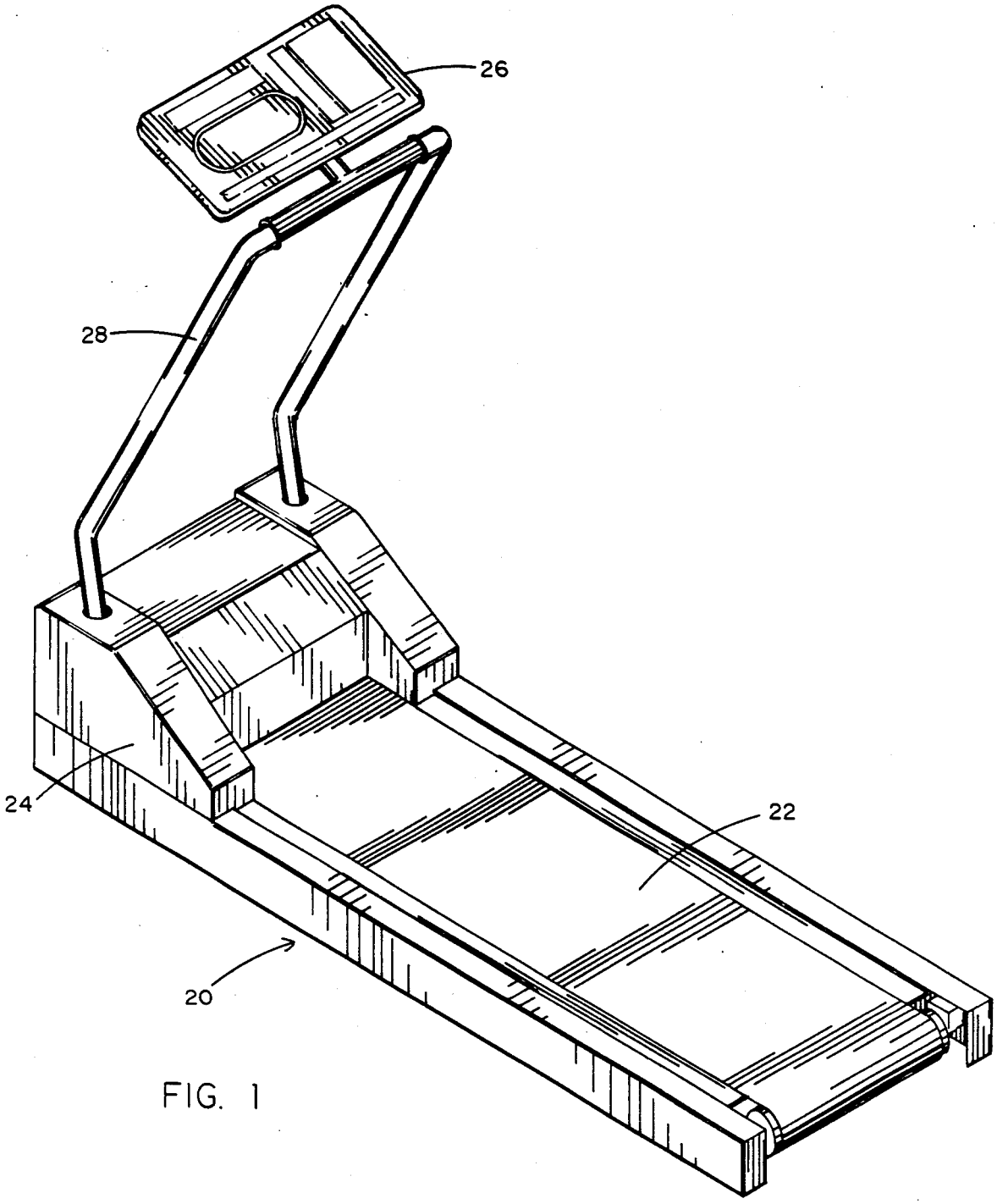
FIG. 1 is an isometric view showing a running/walking machine of the type provided by the present invention.

As shown in FIG. 1, a running machine, or treadmill, 20 has a walking/running surface 22, which is provided by an endless belt. The belt extends around two cylindrical end rollers (not shown), one of which is driven by a motor, preferably a DC electric motor, which is housed in an enclosure 24 located at the front of the apparatus. As the upper surface of the belt moves toward the rear of the apparatus, the user's pace is determined by the speed of the belt motion. A suitable non-moving platform (not shown), which is referred to as a "slider bed", underlies the portion of the belt on which the user is moving. The running platform may have dimensions of approximately 4 to 5 feet length and 1.5 feet width.

The speed of motion of surface 22 may be varied by changing the motor speed. Another variable is the elevation, which may be changed from a horizontal level to a desired degree of inclination by raising the front end of the surface 22, so that the user has the experience of moving up an incline, or hill.

A separate electric motor (i.e., not the belt driving motor) is used to raise or lower the front end elevation. This change of elevation may be effected by rotating round nuts on vertical, non-rotating lead screws. Two such vertical screws, one at each side under the front end of the platform, will suffice to raise and lower the "grade", or degree of inclination, of the moving surface 22. The nuts are rotated by an electric motor, which simultaneously drives the nuts on both vertical screws. The driving force may be conveyed by cog-belts, driven by motor-rotated gears, and press fitted on the peripheries of the respective nuts.

A display (and control) panel 26 is supported on a front rail 28 having the general shape of an inverted "U". The hollow rail structure provides passages for electrical wiring connecting the electronic circuitry in the display panel 26 with the circuitry housed in enclosure 24.

The display panel 26 has the dual functions of accepting command options chosen by the user, and providing information to the user during operation of the apparatus.

There are three general options available to the user. The apparatus can be controlled manually, it can select one of several pre-programmed courses, or it can be programmed for interval training. Under manual control the runner can set speed between one and nine miles per hour (in increments of 0.1 mph), and can adjust track elevation between zero and fifteen percent grade (or from horizontal to an elevation of approximately eight and one half degrees). The pre-programmed courses set speed and elevation automatically. The runner enters the maximum speed, and the program adjusts the speed for each program segment. The eight programs vary in length and maximum grade; Program 1 is the easiest and Program 8 is the hardest. For interval training (or "Laps" mode) the runner programs the speed, elevation, and length of two alternating intervals, plus the number of desired repetitions of both intervals.

Figure 2:
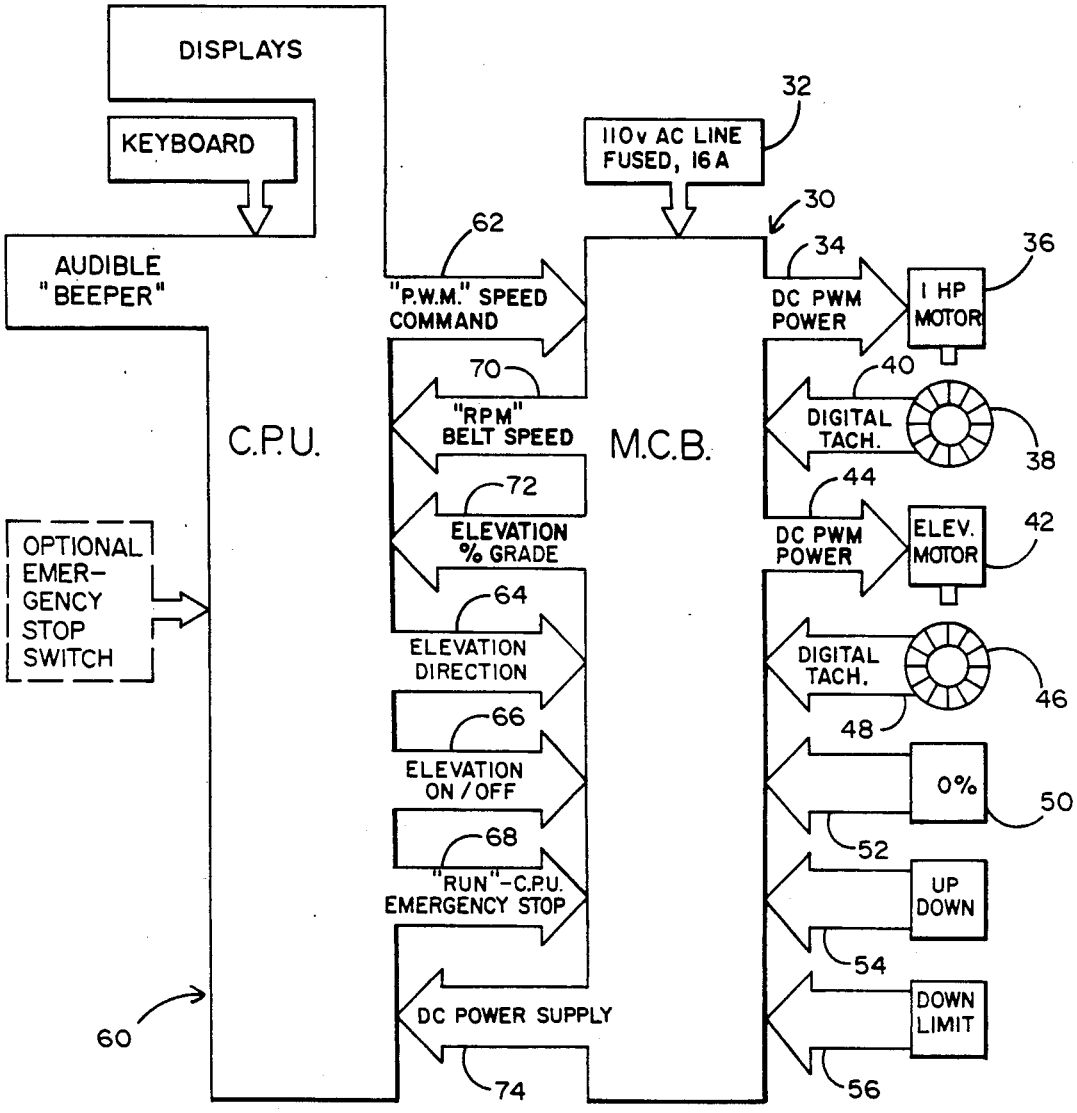
FIG. 2 is a block diagram showing the relationship of the primary components in the apparatus of FIG. 1.

FIG. 2 is a block diagram showing, in a very general way, the operating system components and their interrelationships. A motor control board (MCB) 30 contains the motor driving and speed control circuitry. It receives power from a standard AC line 32 via a power switch and circuit breaker (not shown). It provides driving power via electrical connection 34 to a DC motor 36 which drives the moving belt. The driving power to the motor is provided by an SCR (silicon controlled rectifier) power system, whose duty cycles are controlled by a pulse width modulated (PWM) signal.

The speed of motor 36 determines the running speed of the user. An encoder disk 38, which rotates with the shaft of motor 36, constitutes an optical speed sensor, whose data is transmitted as a digital pulse frequency by an optical shaft encoder, or digital tachometer. A feedback line 40 carries the speed sensor information to the motor control board 30, where it is utilized in an automatic motor speed control circuit. Power is supplied to the shaft encoder 38-40 from the motor control board 30.

A separate, direction-reversible motor 42 causes raising and lowering of the front end by means of the lead screw/nut elevation mechanism. Power is supplied to motor 42 from control board 30 via line 44. This power is also controlled by a PWM signal. The revolutions of motor 42 are sensed by an optical digital sensor 46, which provides elevation feedback information via line 48 to the motor control board 30. Because this sensor can only measure a travel deviation from horizontal, the motor will automatically return to zero elevation when the system is reactivated after power disconnect. This return to 0% elevation is determined by a sensor (micro-switch) 50 which sends its feedback via line 52. As a safety feature, the elevation motor is arranged to be automatically turned off by either an "UP LIMIT" switch 54 or a "DN LIMIT" switch 56, if it tries to move beyond its highest or lowest acceptable levels.

A micro-computer board (CPU) 60 is combined with the display panel. It receives the user's selection inputs from the keyboard, outputs command instructions to the motor control board 30, and computes the data required for operation of the display panel. The command output lines are PWM speed control line 62, elevation direction control line 64, elevation on/off line 66, and emergency stop line 68. Feedback to the CPU is provided by line 70, which carries the encoder data representing the speed of motor 36, and by line 72, which carries the data indicating the position of the elevation mechanism. A power supply line 74 connects control board 30 to CPU 60.

Because of the fact that the exercise system disclosed in this application is driven at a speed automatically established by the program, rather than a speed established by the operator's effort (as in cycles and rowing machines), the user can be thrown off the belt and injured if, for any reason, speed tends to accelerate too rapidly. In other words, if the speed control system erroneously "thinks" that it should accelerate, it will continue to call for faster operation.

FIG. 2 indicates (arrows 34 and 44) that the motor driving power supplied by MCB 30 to both the belt drive motor 36 and the elevation motor 42 is in the form of DC pulse width modulated (duty cycle varied) power.

Figure 3:
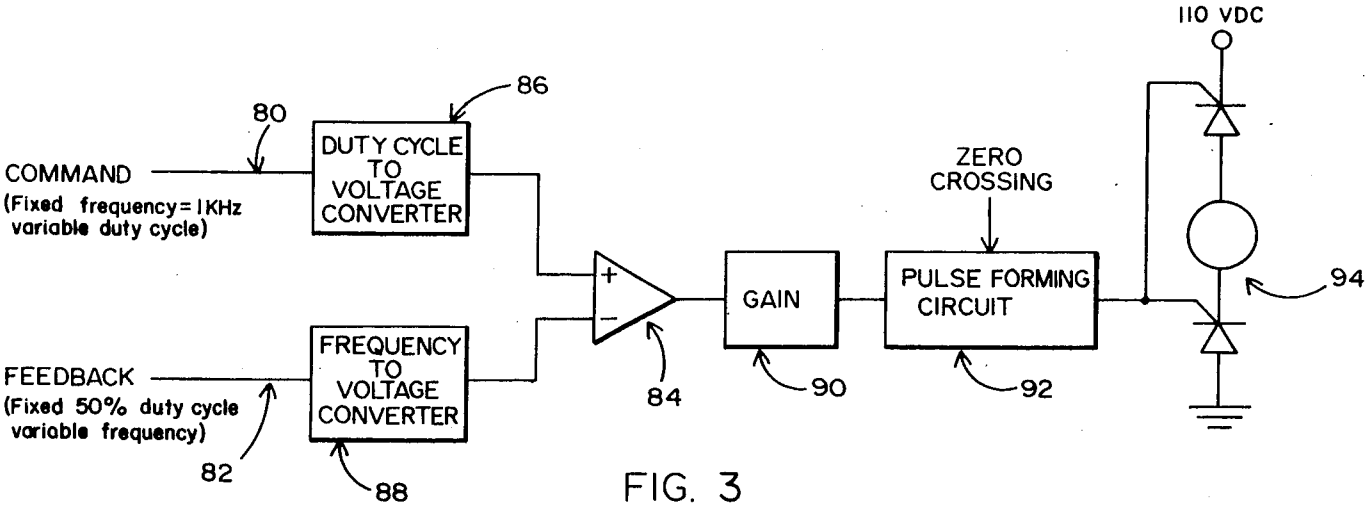
FIG. 3 is a circuit diagram showing the components of the motor control circuit of the apparatus.

FIG. 3 shows diagrammatically a preferred motor control system. The command signal from CPU 60 is input to the MCB (motor control board) 30 on line 80. This command is in the form of a fixed frequency, pulse width modulated (PWM) signal. The fixed frequency may be 1 KHz. The duty cycle of the power pulses is varied in increments or decrements, for the purpose of increasing or decreasing motor speed. In order to minimize "hunting" tendencies, a larger increment/decrement PWM change value is used if the speed is greater than a given amount, e.g., 0.5–0.7 mph; and a smaller increment/decrement PWM change value is used if the speed is lower than that amount.

An advantage of having a PWM command signal from the CPU to the MCB is that only one connecting line is required for the motor speed command data. Thus, the number of interconnections between the CPU and the MCB is minimized, reducing the chance of failure.

The motor speed feedback signal from the encoder is input (in FIG. 3) to the MCB on line 82. It has a fixed duty cycle, e.g., 50%, but a variable frequency.

The determination of difference between command speed and actual speed is accomplished by voltage comparison at a differential amplifier 84. The command signal 80 is converted from a duty cycle signal to an average DC voltage signal by converter circuitry 86. The motor speed feedback signal 82 is converted from a variable frequency signal to an average DC voltage signal by converter circuitry 88. The differential amplifier 84 receives the voltage signal from converter 86 at its positive input terminal, and receives the voltage signal from converter 88 at its negative input terminal.

The output of differential amplifier 84 is a DC voltage proportional to the difference between command and feedback speeds. This output voltage is amplified at 90 (by a factor of, say, 10); and the amplified voltage is input to a pulse forming circuit 92. The output of the pulse forming circuit 92 provides PWM control for SCR power supplying circuitry 94, which determines the driving energy of the motor.

Figure 4:
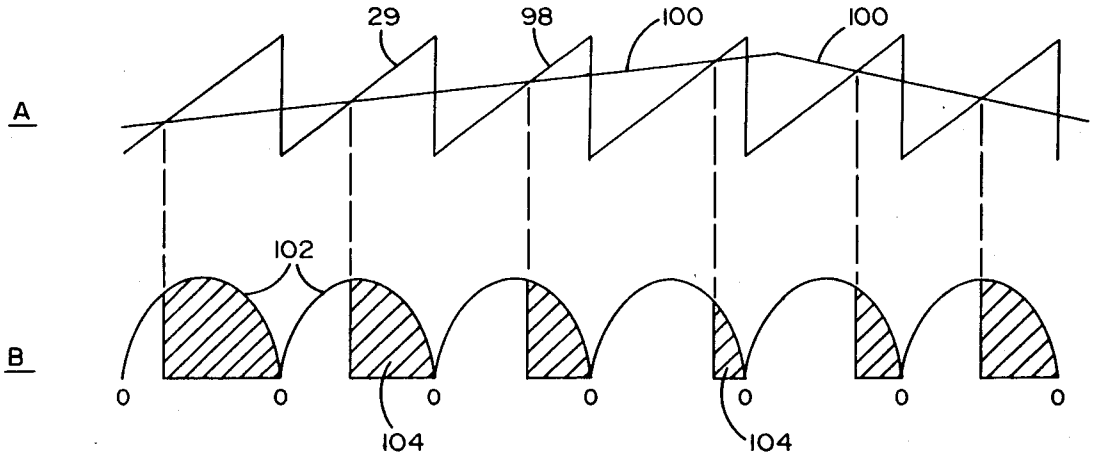
FIG. 4 is a pulse diagram illustrating the operation of the motor speed control.

The control of motor power by PWM input is illustrated in FIG. 4. Line A of the figure shows waveform 98 provided by a sawtooth generator. This is a positive-going ramp signal which resets to ground at zero crossing. Line 100 on the sawtooth waveform represents an inverted error signal (i.e., voltage signal representing difference between command and feedback speeds). Line B of the figure shows waveform 102 of the SCR circuitry. The power provided by the SCR circuitry to the motor turns off at the bottom of each SCR wave, and turns on when the error signal 100 crosses the ramp of the sawtooth generator, as shown. The duty cycle of the SCR circuitry (i.e., its power pulse width) is each period during which it remains turned on, as graphically represented by the shaded areas 104 in the figure.

The variable duty cycle SCR circuitry is preferred because it can handle adequate power, and it provides tighter speed control. A flywheel is desirable to provide an averaging effect, helping to maintain a smooth belt running speed. The motor speed control system, as previously stated, is considered a safety factor in the apparatus, because its tight speed control permits easier detection of operating problems.

Figure 5:
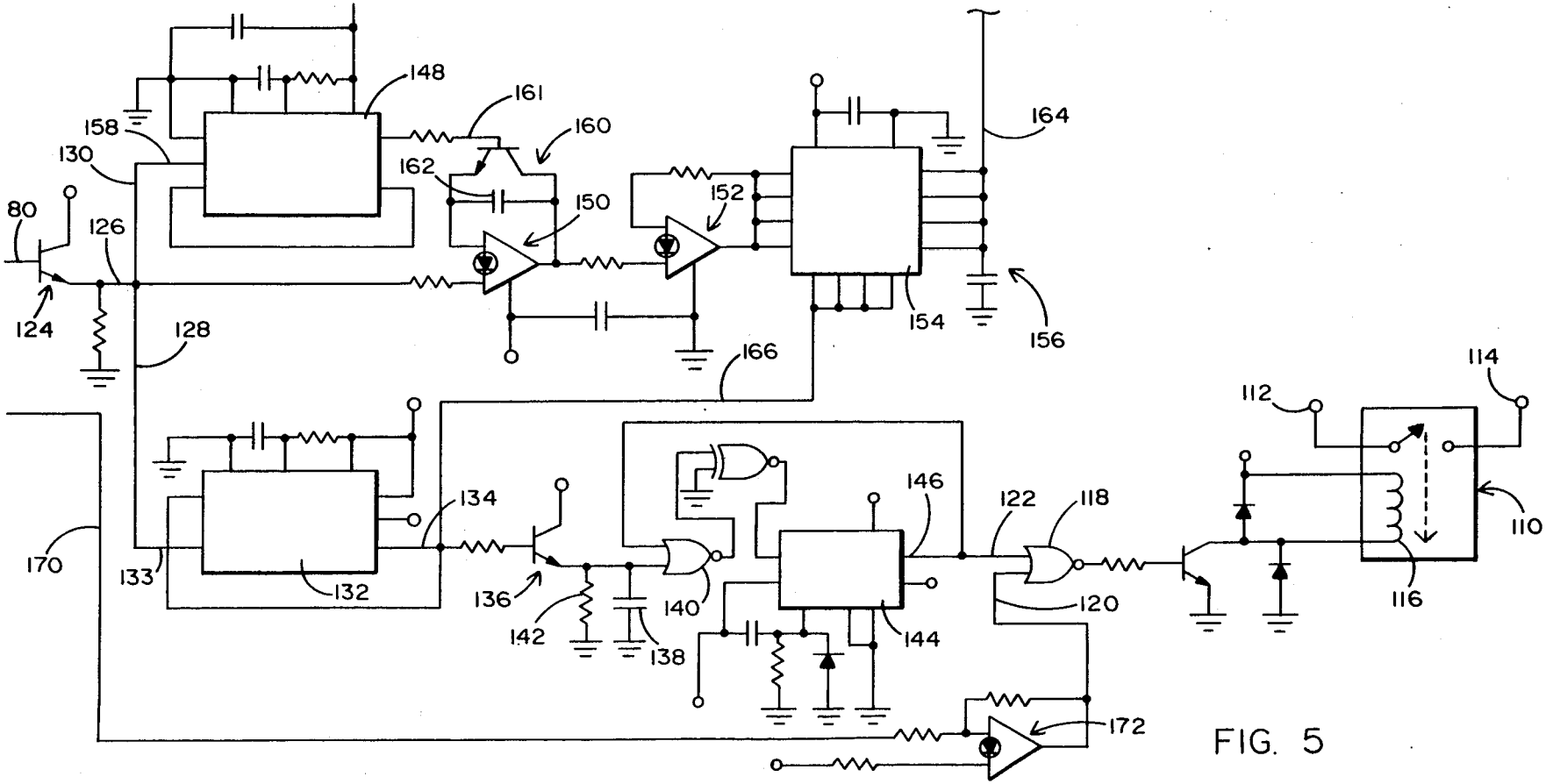
FIG. 5 is a circuit schematic showing motor control board circuitry, including the "watchdog" circuit and the relay shut-off switch.
Figure 6:
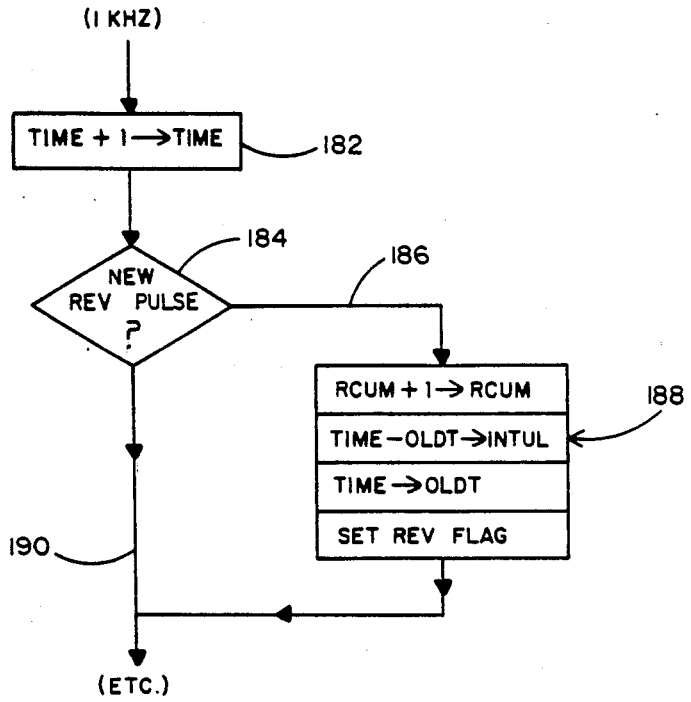
FIGS. 6, 7 and 8 are flow charts showing the CPU logic which provides protection against motor runaway.
Figure 8:
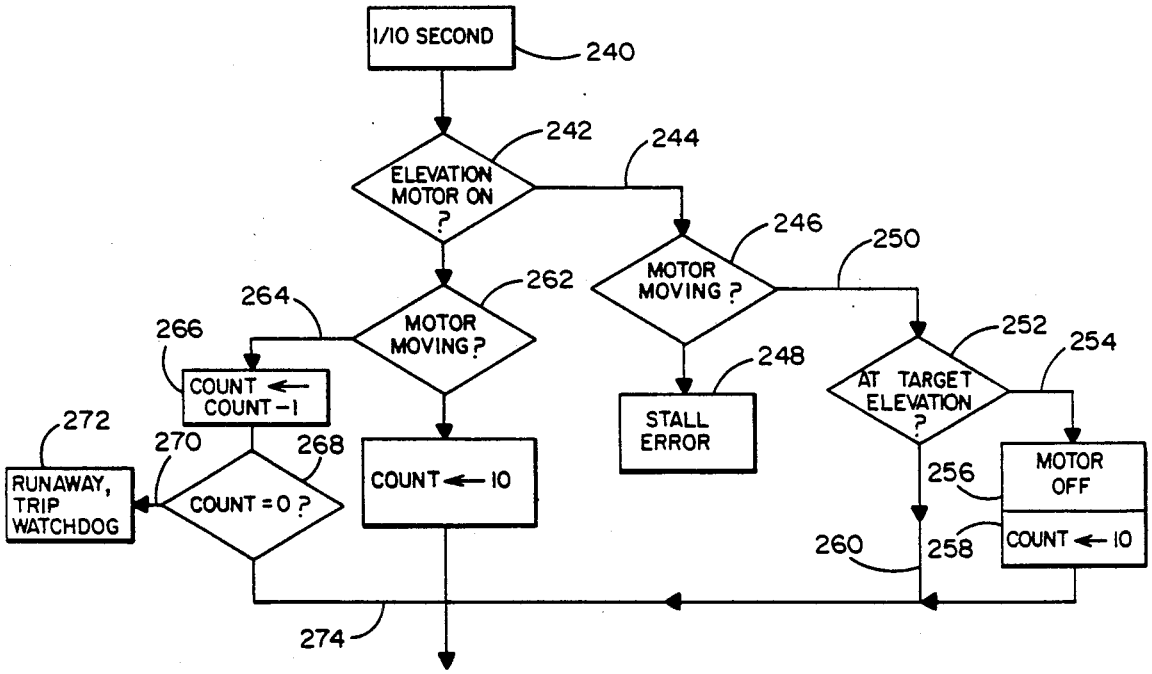
Figure 7:
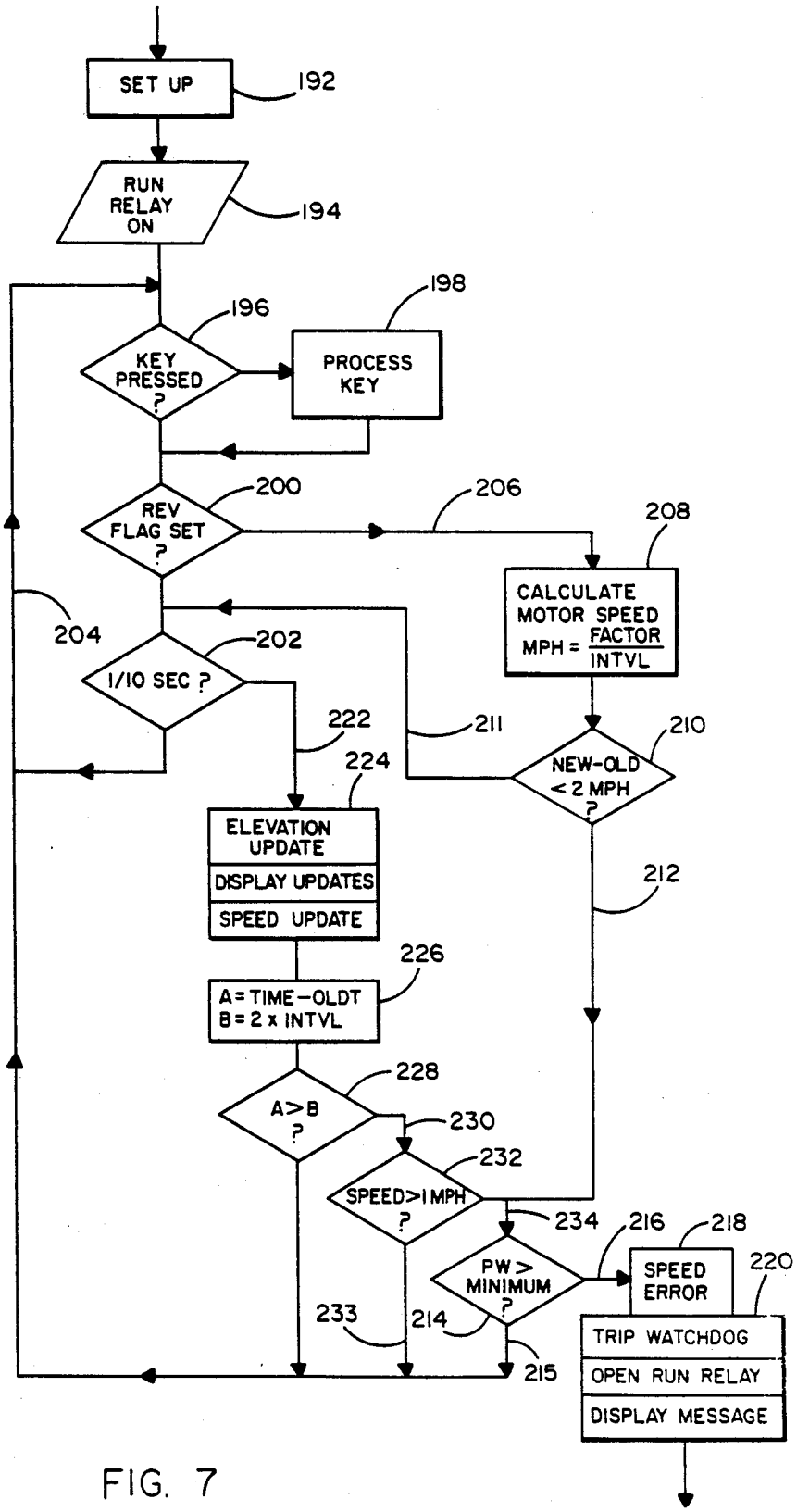

FIGS. 5–8 provide disclosure of the runaway-preventing controls incorporated in the apparatus operating circuitry. FIG. 5 shows portions of the MCB circuitry including the "watchdog" circuit and the relay shut-off switch. FIGS. 6–8 are flow charts illustrating safety controls incorporated in the CPU.

As described above, the speed control circuit receives a command signal from the microprocessor and a feedback signal from the motor shaft encoder, and tries to minimize the difference between them by varying the amount of power to the motor. If the feedback signal is lost, the controller will increase power to the maximum, the belt will accelerate rapidly to its top speed, and will catapult the runner off the end of the belt. This could cause severe injuries.

This situation is detected by the microprocessor. It computes belt speed by timing the interval between pulses from the shaft encoder. If feedback is lost, there is no next pulse. The processor detects loss of signal by subtracting the time of the last pulse from the current time. If the difference exceeds some multiple of the period between the last two pulses received, a loss of feedback can be assumed to have occurred, and the processor can shut off power to the motor circuit. Detection occurs faster at high motor speed than at low motor speed. A loss of feedback at two miles per hour produces a noticeable jerk before shutdown. At six miles per hour and above, the jerk is imperceptible.

A different situation can occur in which the processor has feedback, but the motor controller does not, or when one has intermittent feedback. This condition can be detected by a sudden change in belt speed, exceeding some specified value. Periodically, the microprocessor can compare the time since the last motor pulse with the previous time interval between motor pulses. With this information, a speed error can be detected, and the processor can shut off power to the motor circuit.

The "watchdog" circuit on the motor control board monitors the PWM motor command signal from the CPU. This signal is nominally output at one kilohertz, with a duty cycle range of two percent to fifty percent. If the signal is interrupted for thirty milliseconds, the circuit latches a flip/flop and opens the relay switch, shutting off the motor. Power must be cycled in order to reset the circuit, and restart the motor. The CPU trips the watchdog circuit after any of the above-cited errors, in order to achieve the latching action, and to force the user to turn off the treadmill command system.

Referring to FIG. 5, a safety shut-off relay switch is shown at 110. It is biased toward open position, in which no power is delivered from power supply line 112 to motor drive line 114. As long as coil 116 is energized, the relay switch is closed, and the motor is able to receive driving energy. De-energizing of coil 116 is controlled by a NOR gate 118, which has two input lines, one line 120 coming directly from the microprocessor, and the other line 122 coming from the "watchdog" circuit.

The "watchdog" circuit is monitoring the pulse width modulated line 80 from the display, which is the command to the main drive motor speed circuit. The input to the "watchdog" is from a transistor 124, an emitter follower between command line 80 and output line 126. Transistor 124 is included to give current gain, with little or no voltage gain. Line 126 has branches 128 and 130, the former providing input to a mono-stable multi-vibrator 132, which is triggered by a negative transition on its input 133. Upon a negative transition the one-shot 132 is triggered to the "on" state for approximately a one hundred microseconds period of time; i.e., the output 134 of the one-shot will go high for approximately 100 microseconds. During that time, a transistor 136, also an emitter follower for current gain purposes, is turned on, charging a capacitor 138 to approximately a 10 volts plus level. Since this is a timed phenomenon (100 microseconds), which happens at a frequency of 1 KHz, the average charge on capacitor 138 will stay at some value over half VCC, which is approximately the trip point of a NOR gate 140. If the average voltage across capacitor 138 drops below the trip point level of gate 140, i.e., if a resistor 142 has enough discharge time between input pulses (the time count is set for approximately 33 milliseconds), capacitor 138 will discharge below half VCC, causing a transition on NOR gate 140 and putting a positive-going clock pulse through the gate into a flip-flop 144.

Flip-flop 144 is being used as a latched memory to remember the fact that a clock pulse has been seen. A clock pulse caused by a time-delay transition on gate 140 will trigger the output 146 of the flip-flop to a high state, which, via line 122, disables the drive relay 110, i.e., opens up the relay switch to cut off power to both motor circuits, drive and elevation.

Another desirable feature of the watchdog circuit is that, once the relay switch has been opened, as a result of the flip-flop output going high, the only designed recovery from this latched condition is a power reset. In other words, the power to the machine has to be cycled to the "off" state and then cycled back on. This provides an automatic re-checking of the operating conditions of the treadmill.

The watchdog circuit has its own power-up reset circuit, as does the microprocessor. The microprocessor's power-up reset time is approximately 100 milliseconds. The watchdog's power-up reset time is approximately 300 milliseconds. So the watchdog actually holds the latch 144 in a reset condition for approximately 300 milliseconds after power-up, in order to guarantee that the CPU has had enough time to establish a steady pulse width modulation signal on its output line, which is necessary to maintain the watchdog circuit in the untripped state.

At the input of the motor control circuit, the command signal is pulse width modulation, having a base frequency of 1 KHz, with a minimum of about 2% to a maximum of about 50% "on" time. So 50% of the 1 KHz signal is equal to maximum speed, in terms of command. There is a need to convert this pulse width modulated signal to an average DC voltage output. As previously explained, this is done by a pulse width-to-average-DC-voltage converter circuit. This circuit, which is simple and cost-effective, uses two mono-stable multi-vibrators, or one-shots, 132 and 148, two active amplifiers 150 and 152, and one quad bilateral switch 154. The storage device is a capacitor 156. This circuitry provides a particularly inexpensive sample and hold function.

This sample and hold function essentially is an integrator which incorporates amplifier 150, voltage follower 152, and a time switch to allow the output to supply a voltage capacitor 156. The circuit is dependent upon the input of the pulse width modulation, measuring the high state. During the high state of the pulse width modulation, which varies from a minimum 2% to a maximum 50% duty cycle at a 1 KHz base frequency, the PWM in the input is fed into input 158 of one-shot 148, which is positive edge triggered. Upon receiving a positive edge, the timing process of the mono-stable 148 is started. It is a relatively brief pulse, in contrast to the frequency of 1 KHz. This brief pulse is approximately 100 microseconds in duration. During this 100 microsecond pulse, a transistor 160 is turned on, via line 161; and this causes discharge of a capacitor 162 in the integrator circuit of amplifier 150. That function guarantees a known starting voltage across capacitor 162. After the 100 microsecond period, any further duration of the duty cycle will be used to cause integration from the known voltage level across capacitor 162. It will integrate along a linear up ramp proportional to the on time. At the end of the on time, the CPU puts out a negative-going pulse, which brings the pulse width modulation low. This stops the integration; and it also triggers the one-shot 132 at the 133 input, which puts out a short timed pulse to transfer the voltage at the output of amplifier 150. That voltage is fed, through follower 152 to increase the current drive capacity, through bilateral switch 154, to capacitor 156, where it is stored. This occurs very rapidly, i.e., in 100 microseconds. As long as the frequency is higher than 200 Hz, but less than 20 KHz, the voltage on capacitor 156 is, in fact, directly proportional to the duty cycle at the input 80, i.e., the period of on time at the input.

An output line 164 transfers the voltage stored on capacitor 156 (which represents the command signal) to the positive input of differential amplifier 84 (FIG. 3), where it is compared to the voltage representing the motor speed feedback signal. The voltage transfer from 162 to 156 occurs on the negative edge trigger from one-shot 132, via line 166 and bilateral switch 154. This negative-triggering signal from one-shot 132 thus performs the dual function of controlling the watchdog circuit, and providing the voltage transfer to the motor speed control circuit.

The direct shut-off command from the CPU to relay switch 110, is conveyed to an input of NOR gate 118 via line 120, which receives a CPU command signal on line 170, after that signal is inverted by a transistor 172. As previously stated, this relay switch power shut-off command will occur if one or more system functioning problems are detected by the CPU.

The logic control for this CPU safety function is shown by the flow charts in FIGS. 6, 7 and 8. FIG. 6, which corresponds to FIG. 6 in UNI-7 (except for the identifying numerals), shows a 1 KHz interrupt service routine, beginning with a 1 KHz clock input. The time information in the system is determined by counting clock pulses. A process block 182 sets previous time plus one unit of time as current time. Then a decision, or branch, block 184 determines whether a new motor revolution pulse has come from the encoder disk which senses the motion of the belt drive motor. If the answer is positive, the control flow moves along line 186 to process block 188, in which four actions are accomplished. The cumulative count of revolution pulses is increased by one to set the new count. The new time minus the previous time is calculated to determine the interval, or period, between motor pulses. The new time is reset to appear as the previous time during the next loop. And the revolution flag is set. Either a negative answer at decision block 184, or completion at process block 188 causes control flow to move along line 190 to exit.

The flow chart of FIG. 7 shows the main run loop for the treadmill, including speed error detection. Setup block 192 indicates the start of an operating cycle. At block 194, relay switch 110 (FIG. 5) is energized, making power available to the belt-driving motor. Decision block 196 determines whether a new command key has been pressed by the user. If a new key has been pressed, the new instructions are entered at process block 198.

At decision block 200, it is determined whether another motor revolution pulse has occurred since the previous loop. If not, and if decision block 202 determines that 0.1 second has not passed since the previous loop, the process flow follows line 204 back to block 196. However, if the answer at decision block 200 is "yes", line 206 leads to process block 208, at which current motor speed is calculated, using the last interval between motor revolution pulses.

At decision block 210, it is determined whether the speed change (faster or slower) between the new and old speeds is less than 2 miles per hour. If the answer is "yes", no problem is assumed, and logic flow line 211 leads back to block 202. However, if the speed change is equal to or greater than 2 mph, it is assumed either that the motor control system (not the CPU) has lost feedback from the motor speed sensor, or that an intermittent feedback problem exists.

In this case line 212 leads to a decision block 214, which determines whether the command speed is greater than a pre-established minimum. If the answer is "no", logic line 215 leads back to the top of the loop. However, if the answer at block 214 is "yes", line 216 leads to process block 218, which declares a speed error. At this point, as shown at block 220, relay switch 110 is opened (disabled), shutting off motor power at both the belt drive and elevation motors; the watchdog circuit is "tripped", in order to prevent further operation until the apparatus is "recycled"; and a failure-indicating message is displayed on the display panel.

Returning to consideration of decision blocks 200 and 202, if block 200 gives a negative answer, indicating that no motor revolution pulse has been received, and if block 202 indicates that 0.1 second has passed, line 222 leads to process block 224, where various items of information are updated.

The control flow then moves to process block 226, where two important calculations are made. The value "A" is derived by using TIME minus OLDT. This refers to current time minus previous time, a value from process block 188 in FIG. 6. Also, the value "B" is derived by doubling the INTVL (interval) value, which has been previously determined and stored. This value is also taken from the INTVL calculation at process block 188 of FIG. 6, as is the INTVL value in process block 208.

A crucial decision occurs at block 228, which determines whether "A" is greater than "B". In other words, has a motor pulse failed to occur in a period twice as long as the interval between previous successive motor pulses? If there has been such a hiatus since the last recorded pulse, a problem is likely to have developed in the speed sensor feedback from the motor to the CPU.

If A is found to be greater than B at block 228, line 230 leads to a decision block 232, which determines whether the last sensor feedback speed is greater than 1 mile per hour. If the answer at block 232 is negative, no problem is presumed, and line 233 leads back to the top of the loop. However, if the answer at block 232 is "yes", a loss of speed sensor feedback to the CPU is presumed. Line 234 leads to the final decision block 214, which, as previously stated, determines whether the command speed is greater than a pre-established minimum. If the answer at block 214 is "yes", line 216 leads to process block 218, which declares a speed error, with the consequences already described.

The tenth-second interval for the first check is merely convenient. Motor pulse signals and key depressions are processed when detected. Everything else happens at the ten hertz clock; keys auto-repeat, lights blink, displays are updated, the motor speed and elevation commands are adjusted. The limit of two miles per hour for the second test was chosen because instantaneous differences up to one mile per hour have been measured in the factory under normal circumstances. The reason for excepting conditions when the command is below a given level, or when the speed is below a minimum, is that the treadmill can be abruptly stopped at low speeds; loss of feedback needs to be distinguished from lack of motion.

The flow-chart of FIG. 8 shows the logic system for detecting, and taking action concerning, malfunction of the elevation mechanism. Process block 240 indicates a checking frequency of 10 Hz. At decision block 242, it is determined whether the elevation motor has been commanded to operate. If the answer is positive, line 244 leads to decision block 246, where it is determined whether the motor is moving. If the answer at block 246 is negative, a stall is indicated, as shown at process block 248. This causes both motors to be stopped, after which the relay switch is opened. This sequence prevents arcing, a benefit which is insufficient to justify the same sequence in a runaway situation. Also, if stall is indicated, the watchdog circuit is not tripped.

If the answer at block 246 is positive, line 250 leads to decision block 252, where it is determined whether the target position has been reached. If it has, line 254 leads to process blocks 256 and 258. Block 256 turns off the elevation motor; and block 258 sets at 10 the countdown figure which is used to identify a runaway condition. A negative answer at block 252 leads to line 260 and exit.

The runaway prevention logic begins with a negative answer at decision block 242, followed by a positive answer at a decision block 262, which determines whether the sensor feedback indicates that the elevation motor is moving. If the motor is moving when not commanded to do so, a problem is indicated. Line 264 leads to a countdown process, which comprises a process block 266 which, having started at a count of 10, subtracts 1 count every 0.1 second. If movement continues for 1 second after shutoff command, the count at a decision block 268 will reach zero. Then a positive answer on line 270 will actuate runaway process block 272, causing the same immediate shutdown consequences as process block 218 in FIG. 7. Until the count at block 268 reaches 0, negative line 274 leads to exit.

From the foregoing description, it will be apparent that the apparatus disclosed in this application will provide the significant functional benefits summarized in the introductory portion of the specification.

The following claims are intended not only to cover the specific embodiments disclosed, but also to cover the inventive concepts explained herein with the maximum breadth and comprehensiveness permitted by the prior art.

What is claimed is:

1. In a machine having a moving surface on which a user may walk or run, a motor for driving the moving surface, and means for establishing motor speed commands, a control system comprising:

electronic processor command circuitry for storing and outputting motor speed command signals;

motor control circuitry which receives motor speed command signals from the electronic processor command circuitry and sends speed control signals to the motor;

speed sensing/feedback means for providing motor (or moving surface) speed information;

the motor control circuitry including means for receiving information from the speed sensing means, and means for comparing that information to the motor speed commands;

means for conveying the information from the speed sensing means to the electronic processor command circuitry;

a motor shut-off switch for causing rapid stoppage of power to the motor;

means for detecting a defect in the information from the speed sensing/feedback means to the electronic processor command circuitry; and means responsive to the defect detecting means for actuating the motor shut-off switch.

2. The machine control system of claim 1 in which:

the speed information from the speed sensing means is in the form of timed pulses; and the defect detecting means determines the length of time between pulses from the speed sensing means, and causes actuation of the motor shut-off switch if the time interval after the last such pulse is greater than a predetermined amount.

3. The machine control system of claim 2 which also comprises:

another defect detecting means which responds to the rate of change of motor speed indicated by the variations in intervals between successive speed information pulses, and causes actuation of the motor shut-off switch if the rate of speed change represented by the relation of the latest interval to the previous interval exceeds a certain value.

4. The machine control system of claim 1 in which the defect detecting means determines the rate of speed change from the information provided by the speed sensing means, and causes actuation of the motor shut-off switch if the rate of speed increase is greater than a predetermined amount.

5. The machine control system of claim 1 which also comprises:

protective circuitry associated with the motor control circuitry which causes actuation of the motor shut-off switch if the length of time since the last command signal from the electronic processor exceeds a predetermined amount.

6. In a machine having a moving surface on which a user may walk or run, a motor for driving the moving surface, and means for establishing motor speed commands, a control system comprising:

electronic processor command circuitry for storing and outputting motor speed command signals;

motor control circuitry which receives motor speed command signals from the electronic processor command circuitry and controls the motor speed in accordance with such motor speed command signals;

a motor shut-off switch for causing rapid stoppage of the motor; and protective circuitry which monitors a signal sent by the electronic processor command circuitry, and causes actuation of the motor shut-off switch if the length of time since the last such signal exceeds a predetermined amount.

7. The machine control system of claim 6 which also comprises:

protective circuitry associated with the motor control circuitry which causes actuation of the motor shut-off switch if the length of time since the last command signal from the electronic processor command circuitry exceeds a predetermined amount.

8. A machine having a moving surface on which a user may move, and also having;

a motor for varying the slope of the surface;

means for sensing the rate of change of the slope; and means for causing the motor to stop if the rate of change of the slope is greater than a predetermined value.

9. In an exercise machine having a motor whose speed is controlled by command instructions, and whose speed controls the amount of effort required by the user, motor speed control circuitry comprising:

an electronic processor for storing and outputting user-selected motor speed commands, such commands being output in the form of pulse-width modulated signals;

motor speed sensing means providing motor speed feedback information in the form of variable frequency pulses;

a differential amplifier for outputting a variable voltage proportional to the difference between command and feedback information;

means for converting the pulse width modulated command signals into an average DC voltage signal, and inputting that voltage signal to the differential amplifier;

means for converting the variable frequency pulses from the motor speed sensing means into an average DC voltage signal, and inputting that voltage signal to the differential amplifier;

motor power supplying means; and means for converting the output of the differential amplifier into a signal which varies the power applied to the motor by the motor power supplying means.

10. The exercise machine of claim 9 in which the means for converting the pulse width modulated command signals into an average voltage signal comprises:

a first capacitor for temporarily storing a voltage developed during a single pulse;

a second capacitor for integrating the voltages from the series of pulses;

a first mono-stable multi-vibrator which is triggered by each pulse to cause discharge of the first capacitor during a given period of time, in order to establish a starting voltage on the capacitor, and thereafter cause a voltage increase on the capacitor proportional to the width of the pulse; and a second mono-stable multi-vibrator which is triggered by the end of each pulse to cause voltage transfer from the first capacitor to the second capacitor during a given period of time.

11. A machine having a motor-driven moving surface on which a user may move at a speed determined by the speed of the moving surface, whose control system comprises:

motor operating means for driving the moving surface and controlling its speed;

command means for issuing command signals to which the motor operating means responds;

sensing means for providing information as to the speed of the moving surface;

protective means for independently causing motor shut-off; and monitoring means for detecting a defect of the command means and thereupon automatically causing the protective means to cause motor shut-off.

12. The machine of claim 11 which also comprises:

monitoring means for detecting a defect of the information from the sensing means and thereupon automatically causing the protective means to cause motor shut-off.

13. The machine of claim 12 in which:

the command means is a central processing unit which issues and responds to digital signals, and which includes the monitoring means for detecting a defect of the information from the sensing means;

the sensing means is a high frequency electrical speed measuring device whose information output is in the form of variable frequency digital pulses; and the monitoring of the sensing means by the central processing unit includes (a) means responsive to an absence of signal measured by the time interval after the latest pulse received from the sensing means, and (b) means responsive to the rate of speed change measured by the difference in successive time intervals between successive pulses received from the sensing means.

14. The machine of claim 11 which also comprises:

motor speed variation means which includes (a) electrical circuitry for determining any differential between command speed and actual speed of the moving surface, and (b) means for varying the signals to the motor operating means in order to eliminate such differential.

15. The machine of claim 14 in which:

the sensing means is a high frequency electrical speed measuring device whose information output is in the form of variable frequency electrical pulses; and the electrical pulses from the sensing means are conveyed both to the motor speed variation means and to the command means.

16. The machine of claim 11 in which:

the command means is a central processing unit whose command signals are in the form of digital pulses; and the monitoring means is responsive to successive time intervals between such digital pulses.

17. A machine having a motor-driven moving surface on which a user may move at a speed determined by the speed of the moving surface, whose control system comprises:

motor operating means for driving the moving surface and controlling its speed;

command means for issuing command signals to which the motor operating means responds;

sensing means for providing information as to the speed of the moving surface;

protective means for independently causing motor shut-off; and monitoring means for detecting a defect of the sensing means and thereupon automatically causing the protective means to cause motor shut-off.

18. The machine of claim 17 in which:

the sensing means is a high frequency electrical speed measuring device whose information output is in the form of variable frequency electrical pulses; and the monitoring means is responsive to successive time intervals between such electrical pulses.

* * * * *